US010587053B2

(12) United States Patent
Quitt

(10) Patent No.: US 10,587,053 B2
(45) Date of Patent: Mar. 10, 2020

(54) DIPOLE BEAM MODULE

(71) Applicant: Kathrein SE, Rosenheim (DE)

(72) Inventor: Markus Quitt, Rosenheim (DE)

(73) Assignee: KATHREIN SE (DE)

( * ) Notice: Subject to any disclaimer, the term of this patent is extended or adjusted under 35 U.S.C. 154(b) by 123 days.

(21) Appl. No.: 15/723,483

(22) Filed: Oct. 3, 2017

(65) Prior Publication Data

US 2018/0166793 A1 Jun. 14, 2018

(30) Foreign Application Priority Data

Dec. 9, 2016 (DE) ..... 10 2016 123 997

(51) Int. Cl.
*H01Q 21/06* (2006.01)
*H01Q 5/335* (2015.01)
(Continued)

(52) U.S. Cl.
CPC ..... *H01Q 21/062* (2013.01); *H01Q 1/246* (2013.01); *H01Q 5/335* (2015.01); *H01Q 5/48* (2015.01);
(Continued)

(58) Field of Classification Search
CPC ..... H01Q 21/062; H01Q 9/285; H01Q 5/335; H01Q 1/246; H01Q 9/16; H01Q 5/48;
(Continued)

(56) References Cited

U.S. PATENT DOCUMENTS

2004/0183739 A1* 9/2004 Bisiules ..... H01Q 9/285 343/795
2007/0080883 A1 4/2007 Boss et al.
(Continued)

FOREIGN PATENT DOCUMENTS

CN 103972663 A 8/2014
DE 103 16 786 A1 4/2003
(Continued)

*Primary Examiner* — Hai V Tran
*Assistant Examiner* — Michael M Bouizza
(74) *Attorney, Agent, or Firm* — Fish IP Law, LLP

(57) ABSTRACT

The invention proposes a dipole radiator module, comprising a first and a second dipole radiator. The first dipole radiator comprises two first half-dipole components and two second half-dipole components, of which one is respectively perpendicular to one of the two first half-dipole components. On the respective at a right angle converging ends, at respective outer corner regions of the respective perpendicular to one another first and second half-dipole components, are disposed open areas with first legs, which are spaced apart and associated with each of the first and second half-dipole components, wherein the first legs exhibit a first length. Further comprised are two third half-dipole components, which form a first upper side of the first dipole emitter, and two fourth half-dipole components, of which one is respectively perpendicular to one of the two third half-dipole components, wherein on the respective at a right angle converging ends, at respective outer corner regions of the respective perpendicular to one another third and fourth half-dipole components, are disposed open areas with second legs, which are spaced apart and associated with each of the third and fourth half-dipole components, wherein the second legs exhibit a second length. The second dipole radiator [comprises] two fifth half-dipole components, which form a second underside of the second dipole radiator, as well as two sixth half-dipole components, of which one is respectively perpendicular to one of the two fifth half-dipole components, and wherein the respective at a right angle converging ends of respective outer corner regions of the respective perpendicular to one another fifth and sixth half-dipole components are conductively connected to one another. Further comprised are two seventh half-dipole components, as well as two eighth half-dipole components, of which one is respectively perpendicular to one of the two
(Continued)

seventh half-dipole components, and wherein on the respective at a right angle converging ends, at respective outer corner regions of the respective perpendicular to one another seventh and eighth half-dipole components, are disposed open areas [with] third legs, which are spaced apart and associated with each of the seventh and eighth half-dipole components, wherein the third legs exhibit a third length.

7 Claims, 3 Drawing Sheets

(51) Int. Cl.

| | |
|---|---|
| ***H01Q 9/28*** | (2006.01) |
| ***H01Q 1/24*** | (2006.01) |
| ***H01Q 5/48*** | (2015.01) |
| ***H01Q 9/16*** | (2006.01) |
| *H01Q 21/28* | (2006.01) |
| *H01Q 25/00* | (2006.01) |

(52) U.S. Cl.
CPC ..... *H01Q 9/16* (2013.01); *H01Q 9/285* (2013.01); *H01Q 21/28* (2013.01); *H01Q 25/001* (2013.01)

(58) Field of Classification Search
CPC ..... H01Q 21/28; H01Q 25/001; H01Q 21/00; H01Q 9/28; H01Q 1/36
See application file for complete search history.

(56) References Cited

U.S. PATENT DOCUMENTS

2007/0241983 A1* 10/2007 Cao ..... H01Q 9/285 343/797
2015/0084823 A1* 3/2015 Wang ..... H01Q 25/001 343/797

FOREIGN PATENT DOCUMENTS

DE 20 2005 015 708 U1 12/2005
GB 2517735 A 3/2015

* cited by examiner

DIPOLE BEAM MODULE

This application claims priority to German application number DE 10 2016 123 997.6, filed Dec. 6, 2016. All extrinsic materials identified herein are incorporated by reference in their entirety.

FIELD OF THE INVENTION

The field of the invention is relates to a dipole radiator module.

BACKGROUND

Today's requirements for antennas in the mobile communications field are above all characterized by the need to cover a large frequency band from approx. 600 MHz to at least 2.7 GHz. This can lead to difficulties in the design of the antennas that are intended to cover this entire frequency band. Problems can arise during decoupling if, as is customary, two identical (dipole) radiators are used in one dipole block or dipole module. A full width which is too narrow at half maximum (FWHM), i.e. too small an opening angle, in the upper frequency band range of approximately 2400 to 2690 GHz can result as well. Poor tracking can furthermore occur in this frequency range.

These problems can only partially be solved by interchanging or rotating the radiators, or combining different radiator types. In any case, a large amount of time is needed for calculations and measurements.

One possible solution for the problem can be to design the antennas only for certain frequency bands, i.e. design them separately for each mobile communications market.

Other suggestions for dipole radiator modules or antenna arrays, which solve or improve one or more of the problems, are disclosed, for example, in the European patent specification EP 1 082 781 B1. Here, two differently constructed radiators with different FWHM are combined with one another. This arrangement allows the FWHM of the antenna array to be tuned, making an interconnection with a defined phase position possible. The proposed solution is a good solution for frequency bands up to approx. 2 GHz. For the additional coverage of higher frequency bands, however, problems similar to those described above arise here as well. At the very least, a large amount of computing and measuring effort is required to design the antennas or the antenna array for this extended frequency band spectrum.

Another example of dipole radiators is disclosed in the patent application DE 10316786 A1 submitted by Kathrein-Werke KG, which provides a reflector for an antenna, in particular for a mobile communications antenna, which is characterized by the following features: the reflector is produced, preferably with its two longitudinal side boundaries and preferably with at least one transverse side boundary on the end face, in a casting process, in a deep-drawing or embossing process, or in a milling process, and at least one additional integrated functional part is provided on the reflector, which is likewise produced in a casting process, in a deep-drawing or embossing process or in a milling process. Another example of dipole radiators is disclosed in the patent application US 2007/0080883 A1 submitted by Kathrein-Werke KG, which provides a dual polarized dipole radiator, which radiates in two polarization planes that are perpendicular or substantially perpendicular to one another, and is configured as a dipole square with four sides and, between two corner points, each side comprises two dipole components which, in plan view, are oriented at least approximately in the axial extension. The polarization planes respectively extend through an opposite pair of corner points and, in each case, two dipole components, which converge at a common corner point, are held by means of two feed arms and are electrically fed at a feed point that is provided on the respective dipole component opposite to the associated corner region. In each case, two feed arms, which lead to two dipole components provided on one side of the radiator set-up for the respective feed points, are disposed in parallel or almost parallel at a small lateral distance, and in each case both the dipole components, which converge at a common corner region, and the feed arms, which are connected thereto and respectively extend at least substantially perpendicular to the associated dipole component, are respectively connected to a support section, which extends transversely and preferably perpendicularly to the radiation plane E, wherein two respective adjacent support sections form a balancing unit with a slot between them. The dual-polarized dipole radiator is produced from a strip and/or panel material, in particular a metal sheet, and configured as a single piece, wherein the individual sections of the dual-polarized dipole radiator, including the dipole components, the feed arms, the support sections forming the balancing unit, as well as an associated base connecting the support sections, are connected to one another by bend and/or edge lines and/or fold lines that are introduced into the plate-shaped starting material. A further example of dipole radiators is disclosed in the utility model DE 202005015708 U1 filed by Kathrein-Werke KG, which provides a dipole-shaped radiator arrangement, wherein the dipole-shaped radiator arrangement comprises at least one radiator with at least two radiator halves, via which the dipole-shaped radiator arrangement is operated in at least one polarization plane, and the at least two radiator halves are disposed and/or held in front of an electrically conductive reflector via a carrier, wherein a base or a base point of the carrier is disposed and/or held directly or indirectly on the reflector. The at least one radiator is fed via at least one signal line.

For the above-named reasons, it is a task of this invention to provide a dipole radiator module and an associated array, by means of which the above-named problems are solved. This task is inventively solved by the features of the independent claims. Advantageous embodiments are the subject matter of the dependent claims.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

SUMMARY OF THE INVENTION

The present invention The invention proposes a dipole radiator module, comprising a first dipole radiator, comprising a first dipole with associated first and second half-dipole halves and a second dipole with associated third and fourth half-dipole halves, comprising respective associated half-dipole components, as well as a dipole root that is equipped to hold the first dipole radiator. Two first half-dipole components of the second half-dipole half of the first dipole and the third half-dipole half of the second dipole form a first underside of the first dipole radiator, and two second half-dipole components of the second half-dipole half of the first dipole and the third half-dipole half of the second dipole are respectively perpendicular to one of the two first half-dipole components. On the respective at a right angle converging ends, at respective outer corner regions of the respective perpendicular to one another first and second half-dipole components, are disposed open areas with first legs, which are spaced apart and associated with each of the first and second half-dipole components, wherein the first legs exhibit a first length.

Two third half-dipole components of the first half-dipole half of the first dipole and the fourth half-dipole half of the second dipole form a first upper side of the first dipole radiator. Two fourth half-dipole components of the first half-dipole half of the first dipole and the fourth half-dipole half of the second dipole are respectively perpendicular to one of the two third half-dipole components. On the respective at a right angle converging ends, at respective outer corner regions of the respective perpendicular to one another third and fourth half-dipole components, are disposed open areas with second legs, which are spaced apart and associated with each of the third and fourth half-dipole components, wherein the second legs exhibit a second length. The dipole radiator module further comprises a second dipole radiator, comprising a third dipole with associated first and second half-dipole halves and a fourth dipole with associated third and fourth half-dipole halves, comprising respective associated half-dipole components, and comprising a dipole root that is equipped to hold the second dipole radiator. Two fifth half-dipole components of the second half-dipole half of the third dipole and the third half-dipole half of the fourth dipole form a second underside of the second dipole radiator. Two sixth half-dipole components of the second half-dipole half of the third dipole and the third half-dipole half of the fourth dipole are respectively perpendicular to one of the two fifth half-dipole components. The respective at a right angle converging ends of respective outer corner regions of the respective perpendicular to one another fifth and sixth half-dipole components are conductively connected to one another. Two seventh half-dipole components of the first half-dipole half of the third dipole and the fourth half-dipole half of the fourth dipole form a second upper side of the second dipole radiator. Two eighth half-dipole components of the first half-dipole half of the third dipole and the fourth half-dipole half of the fourth dipole are respectively perpendicular to one of the two seventh half-dipole components. On the respective at a right angle converging ends, at respective outer corner regions of the respective perpendicular to one another seventh and eighth half-dipole components, are disposed open areas with third legs, which are spaced apart and associated with each of the seventh and eighth half-dipole components, wherein the third legs exhibit a third length.

In one design, it is proposed that the first length is shorter than the second length and/or the first length is equivalent to the third length. In one design, the first length is between 0.01 λm and 0.2 λm, wherein λ is the wavelength of the frequency range of the respective dipole and m is the center frequency of the frequency range of the respective dipole. The length of the openings has a very significant effect on the tracking.

In one design, the first legs overlap one another at a predetermined distance from one another, the second legs overlap one another at a predetermined distance from one another and the third legs overlap one another at a predetermined distance from one another.

In one design, the first legs, the second legs and the third legs respectively face the associated inner conductor of the first or second dipole radiator. In one design, the first legs, the second legs and the third legs overlap in such a way that they are substantially parallel to one another.

In one design, the first dipole radiator and the second dipole radiator respectively comprise a balancing unit disposed on each side of the dipole root, wherein a length of the balancing unit is between 0.12 λm and 0.25 λm, wherein λ is the wavelength of the frequency range of the respective dipole and m is the center frequency of the frequency range of the respective dipole. The balancing unit is responsible for compensating the sheath waves. In the claimed design, the balancing unit shifts the undesired sheath waves into an unused frequency range, in this case beyond 2.7 GHz.

The invention further proposes a dipole radiator module comprising a described first dipole radiator and a second dipole radiator connected thereto, wherein the first and the second dipole radiators have the same design and size and the second underside of the first second dipole radiator faces the first upper side of the first dipole radiator, wherein the second dipole radiator is disposed above the first dipole radiator.

The invention further proposes an array comprising at least two described dipole radiator modules for arrangement in an antenna, wherein the at least two dipole radiator modules are disposed spaced vertically one above the other or horizontally with respect to one another, wherein the second dipole radiator is disposed above the first dipole radiator in such a way that the second underside of the second dipole radiator faces the first upper side of the first dipole radiator. In one advantageous embodiment, the first underside of the first dipole radiator faces in the direction of the connections of the antenna.

By combining the first and second dipole radiator in the described design to form one module and then an array, the entire currently (and possibly, i.e. with changes if needed, also later) used frequency band can be covered. This solves the problem of a too narrow FWHM in the upper frequency band or poor tracking, because, due to the approximately equal FWHM of the first and the second dipole radiator, the FWHM can be set according to the desired frequency band and the tracking is improved as a result of the special geometry.

Additional features and advantages of the invention result from the following description of design examples of the invention, on the basis of the figures of the drawing that show details according to the invention, and from the claims. The individual features can be implemented individually or collectively in any desired combination in a variant of the invention.

Preferred embodiments of the invention are explained in more detail in the following with reference to the attached drawing.

DETAILED DESCRIPTION OF THE DRAWINGS

In the following description of the figures, similar elements or functions are provided with the same reference signs.

Figure 1:
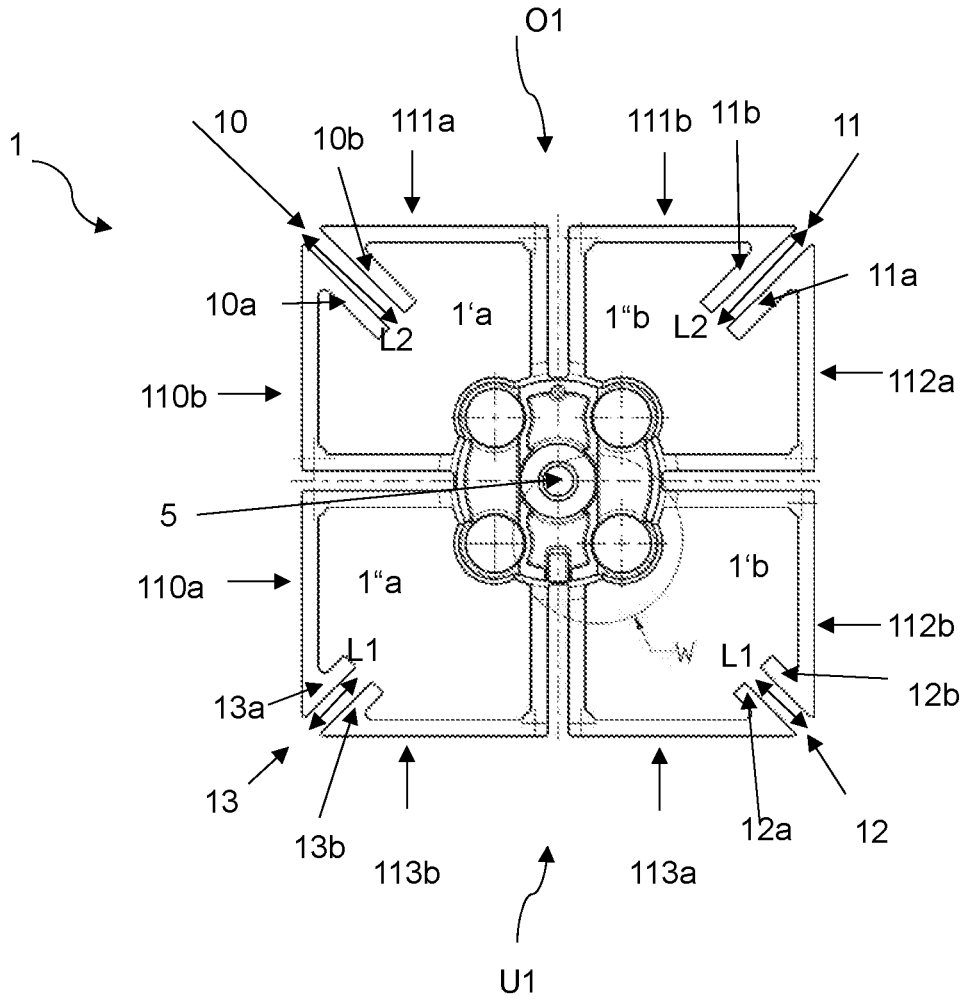
FIG. 1 is a view of a first dipole radiator of a dipole radiator module according to one design of the present invention.
Figure 2:
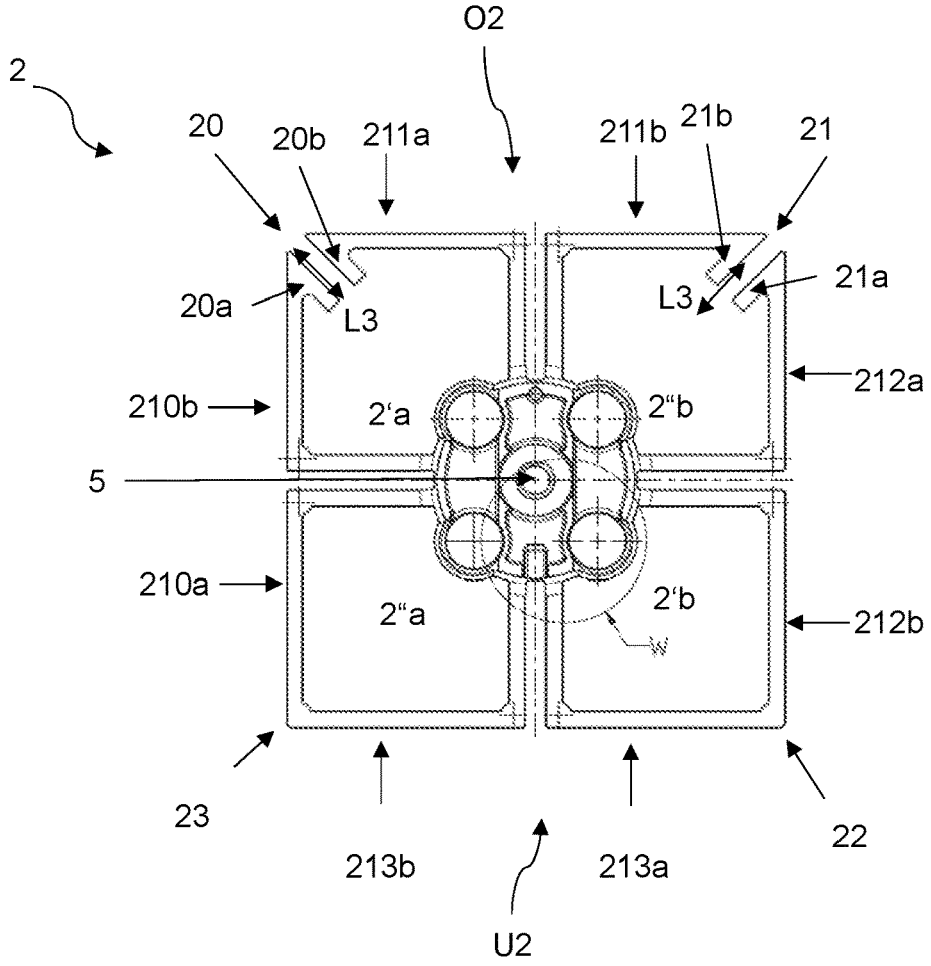
FIG. 2 is a view of a second dipole radiator of a dipole radiator module according to one design of the present invention.

FIGS. 1 and 2 show views of a first and a second dipole radiator 1 and 2 of a dipole radiator module according to one design of the present invention, respectively designed as a dipole square. In this respect, the following description of the similar components applies to both dipole radiators 1 and 2. Separate reference to one of the two dipole radiators 1 or 2 will be made only in the event of discrepancies.

A dipole radiator 1 or 2, configured for example as a dipole square as shown in FIGS. 1 and 2, generally comprises two dipoles with associated half-dipole halves or dipole halves 1*a*'+1*b*' and 1"*a*+1"*b* or 2*a*'+2*b*' and 2"*a*+2"*b*, which in turn can be subdivided into half-dipole components 110*a*, 110*b*, 111*a*, 111*b*, 112*a*, 112*b*, 113*a*, 113*b*; 210*a*, 210*b*, 211*a*, 211*b*, 212*a*, 212*b*, 213*a*, 213*b*. The half-dipole components, or at least their extensions, intersect in their outer corner region 10-13; 20-23.

The depicted dipole radiators 1 and 2 respectively act like a dipole radiating with a polarization of ±45°. The dipole radiators 1 and 2 are respectively formed by an electric dipole with associated half-dipole halves or dipole halves 1'*a* and 1'*b* and a second dipole, which is perpendicular thereto and is formed with associated half-dipole halves or dipole halves 1"*a* and 1"*b*.

The examples shown serve merely for the purpose of illustration. A different polarization of the dipole is possible as well, i.e. the dipole halves can be used in an arrangement other than as described. In such cases, the description applies in an analogous manner.

As shown in FIG. 1, each of the two dipoles of the first radiator comprises respective associated half-dipole halves or dipole halves 1'*a* and 1'*b* for the first dipole as well as the half-dipole halves or dipole halves 1"*a* and 1"*b* for the second dipole.

In doing so, the dipole half 1'*a* is formed by two perpendicular half-dipole components 110*b* and 111*a*. The dipole half 1'*b* is formed by two perpendicular half-dipole components 112*b* and 113*a*. The dipole half 1"*a* is formed by two perpendicular half-dipole components 110*a* and 113*b*. The dipole half 1"*b* is formed by two perpendicular half-dipole components 111*b* and 112*a*.

In the depicted design example, all the half-dipole components 110*b* and 111*a*, 111*b* and 112*a*, 112*b* and 113*a*, 113*b* and 110*a* end with their at a right angle converging ends spaced apart at their respective outer corner regions 10 to 13. In doing so, at their respective outer corner regions 10 to 13 they form legs 10*a*, 10*b*, 11*a*, 11*b*, 12*a*, 12*b*, 13*a*, 13*b*, which are spaced apart and face toward the inside, i.e. in the direction of the inner conductor 5. The distance of the legs to one another is to be selected in such a way that the legs can form a capacitive and not a galvanic coupling with one another.

The two half-dipole components 113*a* and 113*b* form the first underside U1 (in plan view) of the first dipole radiator 1 and the two half-dipole components 111*a* and 111*b* form the first upper side O1 (in plan view) of the first dipole radiator 1.

The same description as for the first dipole radiator 1 applies in an analogous manner, where applicable, for the second dipole radiator 2, namely that each of the two dipoles 2'*a*+2'*b* and 2"*a*+2"*b* of the second dipole radiator 2 comprises respective associated dipole halves 2'*a* and 2'*b* as well as dipole halves 2"*a* and 2'*b*, as shown in FIG. 2.

In doing so, the dipole half 2'*a* is formed by two perpendicular half-dipole components 210*b* and 211*a*. The dipole half 2'*b* is formed by two perpendicular half-dipole components 212*b* and 213*a*. The dipole half 2"*a* is formed by two perpendicular half-dipole components 210*a* and 213*b*. The dipole half 2"*b* is formed by two perpendicular half-dipole components 211*b* and 212*a*.

In the depicted design example, two half-dipole components 210*b* and 211*a*, 211*b* and 212*a* end with their at a right angle converging ends spaced apart at the respective outer corner regions 20 and 21. In doing so, at their respective outer corner regions 20 and 21 they form legs 20*a*, 20*b*, 21*a*, 21*b*, which are spaced apart and face toward the inside, i.e. in the direction of the inner conductor 5. The distance of the legs to one another is to be selected in such a way that the legs can form a capacitive and not a galvanic coupling with one another.

Two other half-dipole components 212*b* and 213*a*, 213*b* and 210*a* are electrically conductively connected to one another at their corner regions 22 and 23. In doing so, the two half-dipole components 212*b* and 213*a*, 213*b* and 210*a* are formed as one piece during production, for example. They can also be connected to one another by means of other methods for producing a fixed connection, however, for example by soldering, welding or other mechanical connections.

The two half-dipole components 213*a* and 213*b*, which are electrically conductively connected to their associated half-dipole components 210*a* and 212*b*, form the second underside U2 (in plan view) of the second dipole radiator 2 and the two half-dipole components 211*a* and 211*b* form the second upper side O2 (in plan view) of the second dipole radiator 2.

As can clearly be seen in FIG. 1, each of the two half-dipole components 113*a* and 113*b* that form the first underside U1 of the first dipole radiator 1, at their corner regions 12 and 13, comprise legs 12*a*, 12*b*, 13*a*, 13*b*, which preferably have the same first length L1. Likewise, each of the two half-dipole components 111*a* and 111*b* that form the first upper side O1 of the first dipole radiator 1, at their corner regions 10 and 11, comprise legs 10*a*, 10*b*, 11*a*, 11*b*, which preferably have the same second length L2. The first length L1 differs from the second length L2 in such a way that the first length L1 is shorter than the second length L2, preferably by 30% to 50%. Both the first length L1 and the second length L2 can lie within a range from 0.01 to 0.2 λm, whereby λ describes the wavelength of the frequency range of the respective dipole and m describes the center frequency of the frequency range of the respective dipole. It is important that the first length L1 is shorter than the second length L2. The exact ratio depends on the application, and can either be calculated or determined through experimentation by the person skilled in the art.

As can clearly be seen in FIG. 2, each of the two half-dipole components 211*a* and 211*b* that form the second upper side O2 of the second dipole radiator 2, at their corner regions 20 and 21, comprise legs 20*a*, 20*b*, 21*a*, 21*b*, which preferably have the same third length L3, whereby said third length L3 is preferably equal to the first length L1 of the legs 12*a*, 12*b*, 13*a*, 13*b* of the first dipole radiator 1.

As already mentioned above, the distance of the legs to one another is to be selected in such a way that the legs can form a capacitive and not a galvanic coupling with one another.

Figure 3A:
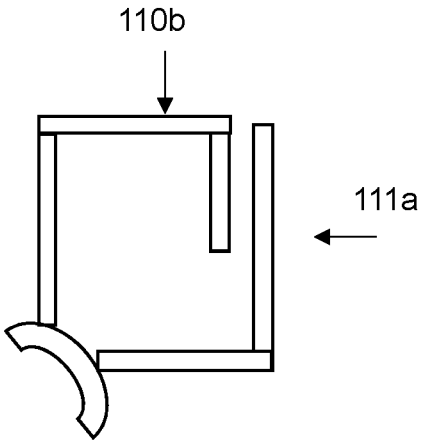
FIGS. 3*a* and 3*b* are alternatively designed dipoles or half-dipole components according to one design of the present invention.
Figure 3B:
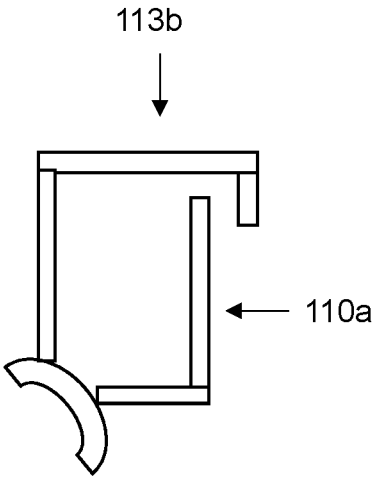

As an alternative to the design shown in FIGS. 1 and 2, the open corner regions 10 to 13 and 20 and 21 can also be designed to be open in a different manner, i.e. not connected to one another, as is shown in FIG. 3*a* or 3*b*. For example, at their ends two half-dipole components can be disposed parallel to one another at a distance from one another by angling one of the two half-dipole components at an angle of at least close to 90° relative to the other half-dipole component, resulting in the two half-dipole components extending parallel to one another. Other options for arranging two open half-dipole components relative to one another not shown in the figures are conceivable as well, provided that the half-dipole components do not touch one another; i.e. they can form a capacitive and not a galvanic coupling with one another. In doing so, as mentioned above, the length of the overlapping regions should preferably lie within a range from 0.01 to 0.2 λm, whereby λ describes the wavelength of the frequency range of the respective dipole and m describes the center frequency of the frequency range of the respective dipole.

The dipole radiators described in FIGS. 1 and 2 are not restricted to the form depicted in these figures; round radiators, in which corresponding open and closed regions are provided, can be used as well. Here too, the length of the open regions is preferably within a range from 0.01 to 0.2 λm, whereby λ describes the wavelength of the frequency range of the respective dipole and m describes the center frequency of the frequency range of the respective dipole.

Figure 4:
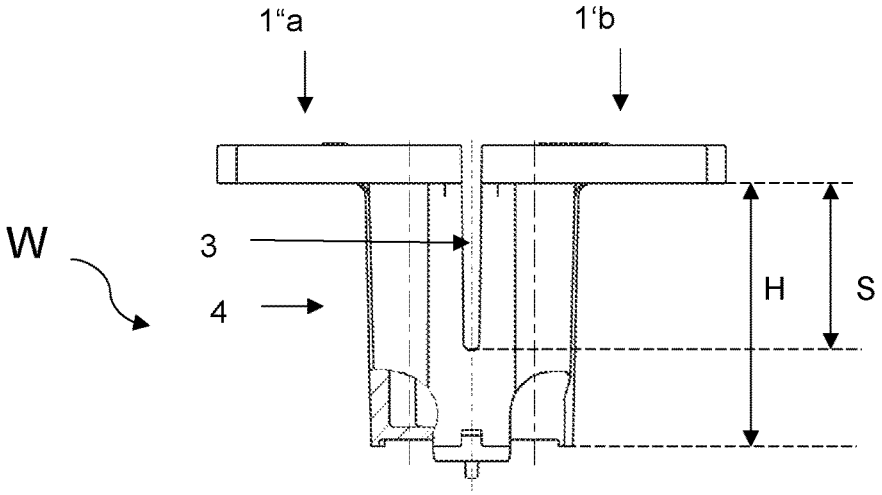
FIG. 4 shows a section W through the dipole radiator of a dipole radiator module according to one design of the present invention shown in FIG. 1 and in FIG. 2.

FIG. 4 shows a sectional view through the region W of FIGS. 1 and 2. A balancing unit 3 can be seen here. A balancing unit 3 is understood to be a component or a region in a component serving as a dipole root 4 for example, for example a recess 3 in a dipole root 4, which serves as a balancing unit, by means of which occurring sheath waves can be compensated. The balancing unit 3 generally extends from the upper side of the dipole root 4 to the lower end of the dipole root 4, for example to a circuit board, on which the dipole root 4 is attached to the dipole radiator 1 or 2, i.e. over the entire length or height H of the dipole root 4. The balancing unit 3 according to the invention, on the other hand, has a length S of preferably 0.12 λm to 0.25 λm, whereby the length S and the height H are measured from the base to the lower edge of the dipole screen, as shown in FIG. 4. By selecting this length S of the balancing unit 3, the frequencies can be shifted to a range above 2.7 GHz, so that sheath waves occurring in this or a higher frequency range have no effect on the functionality of the dipole radiator or the later dipole module or array.

Figure 5:
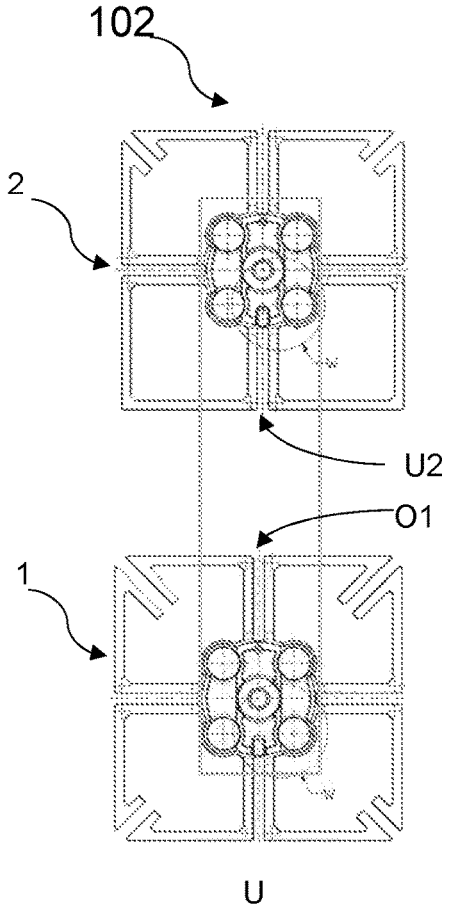
FIG. 5 is a view of a dipole module according to one design of the present invention.

According to this invention, two dipole radiators 1 and 2 with the same design, i.e. they are both round, for example, or they are both configured as squares, are used when they are used together in a dipole radiator module, as shown in FIG. 5. Furthermore, two dipole radiators with at least approximately the same size are used, likewise as shown in FIG. 5.

In doing so, the above-described first dipole radiator 1 and the above-described second dipole radiator 2 are connected to one another to form a dipole radiator module 102 in such a way that the first upper side O1 of the first dipole radiator 1 and the second underside U2 of the second dipole radiator 2 face one another. For this invention, the distance between the two dipole radiators 1 and 2 plays a subordinate role. The narrower the distance, the higher the frequencies that can be covered. It is important that the second dipole radiator 2 is disposed in a vertical arrangement above the first dipole radiator 1, and that the closed side of the second dipole radiator 2, i.e. the second underside U2, faces down U, i.e. toward to the first upper side O1 of the first dipole radiator 1. In this case, the term "down" U can mean in the direction of the connections of the antenna, in which the dipole radiator module 102 is or can be disposed, i.e. in the direction of the base, if it is disposed in a vertical manner.

The two used first and second dipole radiators 1 and 2 preferably have the same design and size. Due to the special geometry of the individual radiators and the corresponding arrangement with respect to one another, they additionally at least approximately exhibit the same FWHM, preferably between 60° and 70°, preferably ca.±65°. As a result, an overall narrower FWHM is achieved in the whole system and with it a better adjustment of the direction. Aiding this are, for example, the open legs. The open legs also help with tracking.

Figure 6:
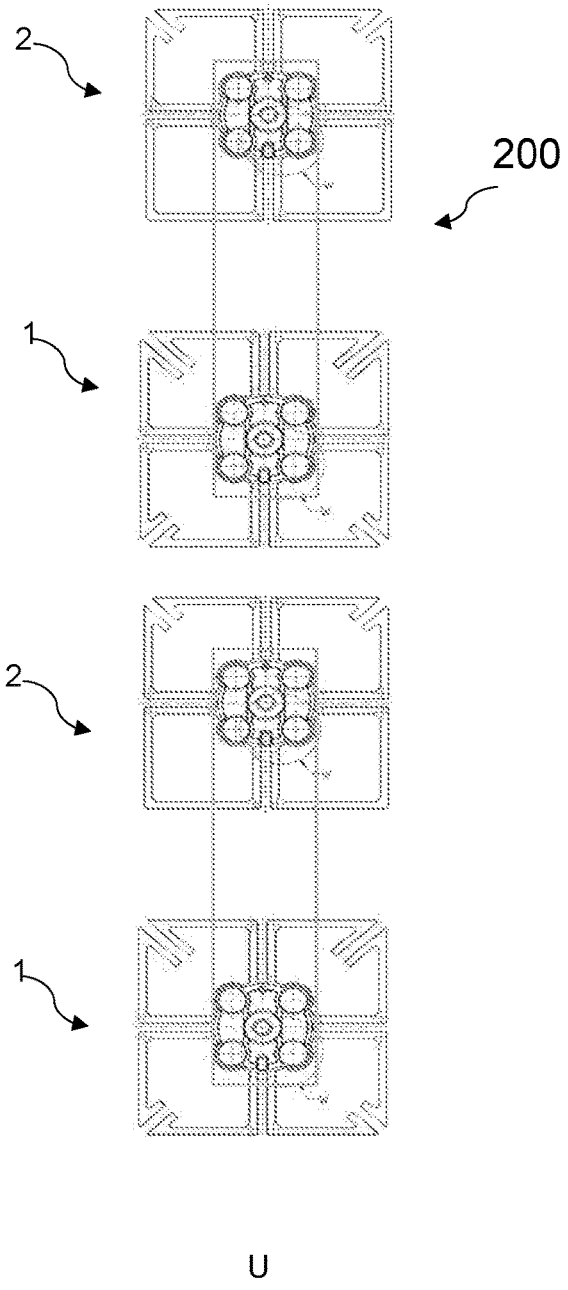
FIG. 6 is a view of a vertically arranged array according to one design of the present invention

FIG. 6 shows an array 200 with a plurality of dipole radiator modules 102 disposed one above the other as described above. This is merely one example of how an array can be configured. A plurality of dipole radiator modules 102 can also be arranged horizontally, i.e. next to one another. A combination of vertically and horizontally arranged dipole radiator modules 102 can also be used to achieve the desired effect. Due to the special geometry of the individual radiators and the corresponding arrangement with respect to one another, a very wide frequency band up to 2.7 GHz can be covered without having to accept excessively narrow FWHM in the upper frequency band of approximately 2400-2690 GHz or poor tracking. Due to the approximately equal FWHM of each of the individual radiators in the desired range, a narrower FWHM can be achieved in the whole system. Furthermore, due to the modular design, i.e. only one invariably identical dipole radiator module 102 is required to assemble the array 200, the computing and measuring effort can be reduced, and simpler storage can be achieved.

LIST OF REFERENCE SIGNS

1 first dipole radiator
1'*a*+1'*b* first dipole
1'*a*, dipole half first dipole or half-dipole half first dipole
1'*b* dipole half first dipole or half-dipole half first dipole
1"*a*+1"*b* second dipole
1"*a* dipole half second dipole or half-dipole half second dipole
1"*b* dipole half second dipole or half-dipole half second dipole
110*a*, 110*b*, 111*a*, 111*b*, 112*a*, 112*b*, 113*a*, 113*b* half-dipole components
10-13 corner region
10*a*, 10*b* leg
11*a*, 11*b* leg
12*a*, 12*b* leg
13*a*, 13*b* leg
U1 first underside
O1 first upper side
2 second dipole radiator
2'*a*+2'*b* first dipole
2'*a*, dipole half first dipole or half-dipole half second dipole
2'*b* dipole half first dipole or half-dipole half first dipole
2"*a*+2"*b* second dipole
2"*a* dipole half second dipole or half-dipole half second dipole

**2"*b*** dipole half second dipole or half-dipole half second dipole
**210*a*, 210*b*, 211*a*, 211*b*, 212*a*, 212*b*, 213*a*, 213*b*** half-dipole components
20-23 corner region
**20*a*, 20*b*** leg
**21*a*, 21*b*** leg
**22*a*, 22*b*** leg
**23*a*, 23*b*** leg
U2 second underside
O2 second upper side
3 balancing unit
4 dipole root
5 inner conductor
U lower side of a vertical arrangement, base
102 dipole radiator module
200 Antenna array

What is claimed is:

1. A dipole radiator module (102), comprising:

a first dipole radiator (1), comprising a first dipole (**1'*a*+1'*b*) with associated first (1'*a*) and second half-dipole halves (1'*b*) and a second dipole (1"*a*+1"*b*) with associated third (1"*a*) and fourth half-dipole halves (1"*b*), comprising respective associated half-dipole components (110*a*, 110*b*, 111*a*, 111*b*, 112*a*, 112*b*, 113*a*, 113*b*), as well as a dipole root (4), which is equipped to hold the first dipole radiator (1), wherein two first half-dipole components (113*a*, 113*b*) of the second half-dipole half of the first dipole (1'*b*) and the third half-dipole half of the second dipole (1"*a*) form a first underside (U1) of the first dipole radiator (1), and wherein two second half-dipole components (110*a*, 112*b*) of the second half-dipole half of the first dipole (1'*b*) and the third half-dipole half of the second dipole (1"*a*) are respectively perpendicular to one of the two first half-dipole components (113*a*, 113*b*), and wherein on the respective at a right angle converging ends, at respective outer corner regions (12, 13) of the respective perpendicular to one another first and second half-dipole components (113*a*, 113*b*; 110*a*, 112*b*), are disposed open areas with first legs (12*a*, 12*b*; 13*a*, 13*b*), which are spaced apart and associated with each of the first and second half-dipole components (111*a*, 111*b*; 110*b*, 112*a*), wherein the first legs (12*a*, 12*b*; 13*a*, 13*b*) exhibit a first length (L1) between 0.01 λm and 0.2 λm, wherein λ is the wavelength of the frequency range of the respective dipole and m is the center frequency of the frequency range of the respective dipole, and wherein two third half-dipole components (111*a*, 111*b*) of the first half-dipole half of the first dipole (1'*a*) and the fourth half-dipole half of the second dipole (1"*b*) form a first upper side (O1) of the first dipole radiator (1), and wherein two fourth half-dipole components (110*b*, 112*a*) of the first half-dipole half of the first dipole (1'*a*) and the fourth half-dipole half of the second dipole (1"*b*) are respectively perpendicular to one of the two third half-dipole components (111*a*, 111*b*), and wherein on the respective at a right angle converging ends, at respective outer corner regions (10, 11) of the respective perpendicular to one another third and fourth half-dipole components (111*a*, 111*b*; 110*b*, 112*a*), are disposed open areas with second legs (10*a*, 10*b*; 11*a*, 11*b*), which are spaced apart and associated with each of the third and fourth half-dipole components (111*a*, 111*b*; 110*b*, 112*a*), wherein the second legs (10*a*, 10*b*; 11*a*, 11*b*) exhibit a second length (L2); and comprising a second dipole radiator (2), comprising a third dipole (2'*a*+2'*b*) with associated first (2'*a*) and second half-dipole halves (2'*b*) and a fourth dipole (2"*a*+2"*b*) with associated third (2"*a*) and fourth half-dipole halves (2"*b*), comprising respective associated half-dipole components (210*a*, 210*b*, 211*a*, 211*b*, 212*a*, 212*b*, 213*a*, 213*b*), as well as comprising a dipole root (4), which is equipped to hold the second dipole radiator (2), wherein two fifth half-dipole components (213*a*, 213*b*) of the second half-dipole half of the third dipole (2'*b*) and the third half-dipole half of the fourth dipole (2"*a*) form a second underside (U2) of the second dipole radiator (2), and wherein two sixth half-dipole components (210*a* and 212*b*) of the second half-dipole half of the third dipole (2'*b*) and the third half-dipole half of the fourth dipole (2"*a*) are respectively perpendicular to one of the two fifth half-dipole components (213*a*, 213*b*), and wherein the respective at a right angle converging ends of respective outer corner regions (22, 23) of the respective perpendicular to one another fifth and sixth half-dipole components (213*a*, 213*b*; 210*a* and 212*b*) are conductively connected to one another; and wherein two seventh half-dipole components (211*a*, 211*b*) of the first half-dipole half of the third dipole (2'*a*) and the fourth half-dipole half of the fourth dipole (2"*b*) form a second upper side (O2) of the second dipole radiator (2), and wherein two eighth half-dipole components (210*b* and 212*a*) of the first half-dipole half of the third dipole (2\'*a*) and the fourth half-dipole half of the fourth dipole (2"*b*) are respectively perpendicular to one of the two seventh half-dipole components (211*a*, 211*b*), and wherein on the respective at a right angle converging ends, at respective outer corner regions (21, 21) of the respective perpendicular to one another seventh and eighth half-dipole components (211*a*, 211*b*; 210*b* and 212*a*), are disposed open areas with third legs (20*a*, 20*b*; 21*a*, 21*b*), which are spaced apart and associated with each of the seventh and eighth half-dipole components (211*a*, 211*b*; 210*b*, 212*a*), wherein the third legs (20*a*, 20*b*; 21*a*, 21*b*) exhibit a third length (L3), and wherein the second underside (U2) of the second dipole radiator (2) faces the first upper side (O1) of the first dipole radiator (1), wherein the second dipole radiator (2) is disposed above the first dipole radiator (1), and wherein the first and the second dipole radiator (1; 2**) have the same design and size.

2. The dipole radiator module (102) according to claim 1, wherein the first length (L1) is shorter than the second length (L2) and/or the first length (L1) is equivalent to the third length (L3).

3. The dipole radiator module (102) according to claim 2, wherein the first legs (**12*a*, 12*b*; 13*a*, 13*b*) overlap one another at a predetermined distance from one another, the second legs (10*a*, 10*b*; 11*a*, lib) overlap one another at a predetermined distance from one another and the third legs (20*a*, 20*b*; 21*a*, 21*b***) overlap one another at a predetermined distance from one another.

4. The dipole radiator module (102) according to claim 3, wherein the first legs (**12*a*, 12*b*; 13*a*, 13*b*), the second legs (10*a*, 10*b*; 11*a*, 11*b*) and the third legs (20*a*, 20*b*; 21*a*, 21*b*) respectively face an inner conductor (5) of the associated first or second dipole radiator (1; 2**).

5. The dipole radiator module (102) according to claim 4, wherein the first legs (12*a*, 12*b*; 13*a*, 13*b*), the second legs (10*a*, 10*b*; 11*a*, 11*b*) and the third legs (20*a*, 20*b*; 21*a*, 21*b*) overlap in such a way that they are substantially parallel to one another.

6. The dipole radiator module (102) according to claim 5, wherein the first and the second dipole radiator respectively comprise a balancing unit (3) disposed on each side of the dipole root (4), wherein a length (S) of the balancing unit (3) is between 0.12 λm and 0.25 λm, wherein λ is the wavelength of the frequency range of the respective dipole and m is the center frequency of the frequency range of the respective dipole.

7. An array (200), comprising at least two dipole radiator modules (102) according to claim 1 for arrangement in an antenna, wherein the at least two dipole radiator modules (102) are disposed spaced vertically one above the other or horizontally with respect to one another, wherein the second dipole radiator (2) is disposed above the first dipole radiator (1) in such a way that the second underside (U2) of the second dipole radiator (2) faces the first upper side (O1) of the first dipole radiator (1).

* * * * *